US009093025B2

(12) United States Patent
Lee et al.

(10) Patent No.: US 9,093,025 B2
(45) Date of Patent: Jul. 28, 2015

(54) ORGANIC LIGHT EMITTING DISPLAY DEVICE AND DRIVING METHOD THEREOF

(71) Applicant: LG Display Co., Ltd., Seoul (KR)

(72) Inventors: Munjun Lee, Paju-si (KR); Hyungjung Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 134 days.

(21) Appl. No.: 13/623,678

(22) Filed: Sep. 20, 2012

(65) Prior Publication Data

US 2013/0076803 A1 Mar. 28, 2013

(30) Foreign Application Priority Data

Sep. 23, 2011 (KR) ..... 10-2011-0096544

(51) Int. Cl.
*G09G 3/32* (2006.01)

(52) U.S. Cl.
CPC ..... *G09G 3/3233* (2013.01); *G09G 3/3266* (2013.01); *G09G 3/3291* (2013.01); *G09G 2300/0452* (2013.01); *G09G 2310/027* (2013.01); *G09G 2320/0673* (2013.01); *G09G 2320/103* (2013.01); *G09G 2330/021* (2013.01); *G09G 2340/06* (2013.01); *G09G 2360/16* (2013.01)

(58) Field of Classification Search
CPC . G09G 3/3233; G09G 3/3241; G09G 3/3258; G09G 3/3275; G09G 3/3283; G09G 3/3291; G09G 2310/0264; G09G 2310/027; G09G 2330/028; H04N 5/202; H04N 5/57
USPC ..... 345/690
See application file for complete search history.

(56) References Cited

U.S. PATENT DOCUMENTS

| | | | | |
|---|---|---|---|---|
| 7,447,379 | B2 * | 11/2008 | Choe et al. | 382/274 |
| 7,826,680 | B2 * | 11/2010 | Neal | 382/274 |
| 7,982,693 | B2 * | 7/2011 | Mizukoshi et al. | 345/76 |
| 8,125,569 | B2 * | 2/2012 | Flores et al. | 348/672 |
| 8,325,115 | B2 * | 12/2012 | Tada et al. | 345/77 |
| 8,379,040 | B2 * | 2/2013 | Mori | 345/589 |
| 2006/0087521 | A1 * | 4/2006 | Chu et al. | 345/690 |
| 2007/0001939 | A1 * | 1/2007 | Hashimoto et al. | 345/76 |
| 2009/0160880 | A1 * | 6/2009 | Park et al. | 345/690 |
| 2011/0115766 | A1 * | 5/2011 | Kerofsky et al. | 345/207 |

OTHER PUBLICATIONS

Byung-Hwee Part et al., "A novel image quality enhancement method for AMOLEDs," SID 08 Digest, pp. 1371-1374, 2008.*

Tsujimura, "OLED Display Fundamentals and Applications", Sec. 4.2, John Wiley & Sons, Inc., 2012 (retrieved from safaribooksonline.com on Jan. 7, 2015).*

* cited by examiner

*Primary Examiner* — Quan-Zhen Wang
*Assistant Examiner* — Xuemei Zheng
(74) *Attorney, Agent, or Firm* — Fenwick & West LLP

(57) ABSTRACT

An organic light emitting display device includes: an APL calculation unit; a current value calculation unit output a first result value or output a second result value; a peak luminance controller configured to output a first luminance control signal based on a first gamma conversion value when receiving the first result value from the current value calculation unit and output a second luminance control signal based on a second gamma conversion value when receiving the second value from the current value calculation unit; a programmable gamma unit configured to output a gamma voltage; and a data driver configured to generate a data signal and supply the generated data signal to a display panel.

11 Claims, 9 Drawing Sheets

ORGANIC LIGHT EMITTING DISPLAY DEVICE AND DRIVING METHOD THEREOF

CROSS-REFERENCE TO RELATED APPLICATION

This application claims priority under 35 U.S.C. §119(a) on Patent Application No. 10-2011-0096544 filed in Republic of Korea on Sep. 23, 2011, the entire contents of which are hereby incorporated by reference.

BACKGROUND

1. Field of the Invention

This disclosure relates to an organic light emitting display device and a driving method thereof.

2. Related Art

An organic electro-luminescence (EL) element (or an organic light emitting diode (OLED)) employed in an organic light emitting display device is a self-emissive display in which a light emitting layer is formed between two electrodes. In the organic EL element, electrons and holes are injected into a light emitting layer from an electron injection electrode (or a cathode) and a hole injection electrode (or an anode), respectively, and excitons formed as injected electrons and holes are combined to emit light when shifted from an excited state to a ground state.

In the organic light emitting display device, when scan signals, data signals, power, and the like, are supplied to subpixels disposed in a matrix form, selected subpixels emit lightto display an image.

Some organic light emitting display devices have a subpixel structure including red, green, blue, and white colors (referred to as 'RGBW OLED', hereinafter). The RGBW OLED is driven such that subpixels selected from among RGB subpixels are further turned on in a display panel in order to correct white color coordinates.

The RGBW OLED lowers luminance through a peak luminance control (PLC) method in a particular image (consuming much power) in order to maintain power consumption below a target level. The PLC method is a method of implementing maximum luminance by varying a gamma voltage according to an average picture level (APL) calculated for a maximum component of an RGB data signal.

In a PLC method, a contrast ratio (CR) is enhanced by increasing luminance of a particular image in order to enhance perceptual picture quality, rather than lowering power consumption. However, the use of the PLC method may exceed a consumption power limit level of the RGBW OLED despite decrease in power consumption. Therefore, the PLC method should be improved to operate the RGBW OLED within the consumption power limit.

SUMMARY

In an aspect, an organic light emitting display device includes: an average picture level (APL) calculation unit configured to calculate an APL of an input image; a current value calculation unit configured to calculate a current value with respect to the APL, output a first result value when a calculated current value corresponds to a target current value, and output a second result value when a calculated current value differs from the target current value; a peak luminance controller configured to output a first luminance control signal based on a first gamma conversion value when receiving the first result value from the current value calculation unit and output a second luminance control signal based on a second gamma conversion value when receiving the second value from the current value calculation unit; a programmable gamma unit configured to output a gamma voltage corresponding to a luminance control signal supplied from the peak luminance controller; and a data driver configured to generate a data signal based on the gamma voltage supplied from the programmable gamma unit and supply the generated data signal to a display panel.

In another aspect, a method for driving an organic light emitting display device includes: calculating an average picture level (APL) of an input image; calculating a current value with respect to the APL; determining whether or not the calculated current value corresponds to a target current value; outputting a first luminance control signal based on a first gamma conversion value corresponding to a fixed gamma when the calculate current value corresponds to the target current value, and outputting a second luminance control signal based on a first gamma conversion value corresponding to a variable gamma when the calculate current value differs from the target current value; and generating a data signal based on a gamma voltage corresponding to one of the first luminance control signal and the second luminance control signal, and displaying an image.

BRIEF DESCRIPTION OF THE DRAWINGS

The accompany drawings, which are included to provide a further understanding of the invention and are incorporated on and constitute a part of this specification illustrate embodiments of the invention and together with the description serve to explain the principles of the invention.

DETAILED DESCRIPTION

Reference will now be made in detail embodiments of the invention examples of which are illustrated in the accompanying drawings.

Hereinafter, embodiments of the present invention will be described in detail with reference to the accompanying drawings.

Figure 1:
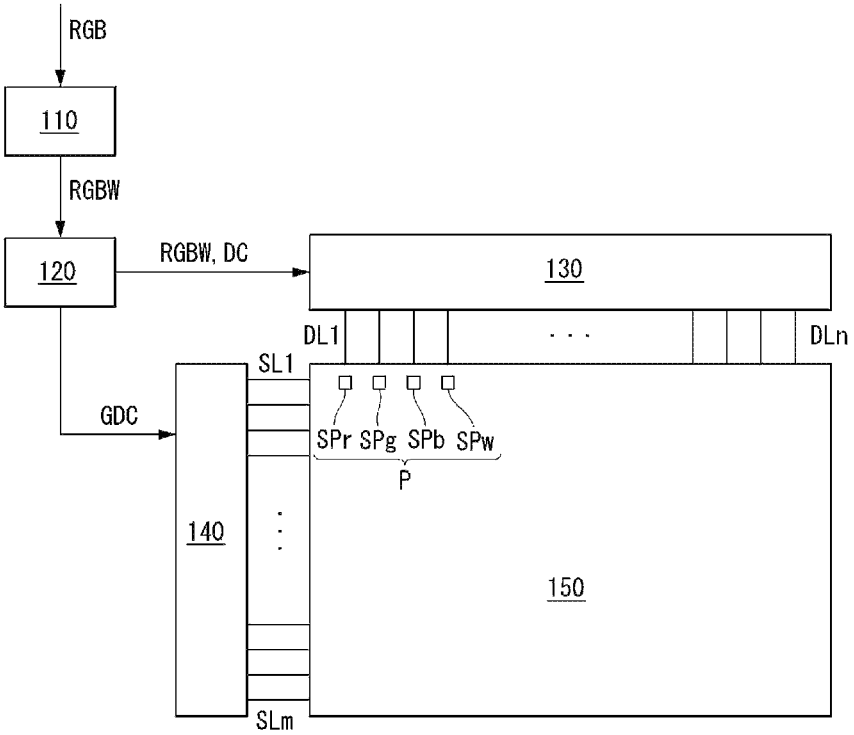
FIG. 1 is a schematic block diagram of an organic light emitting display device according to an embodiment of the present invention.
Figure 2:
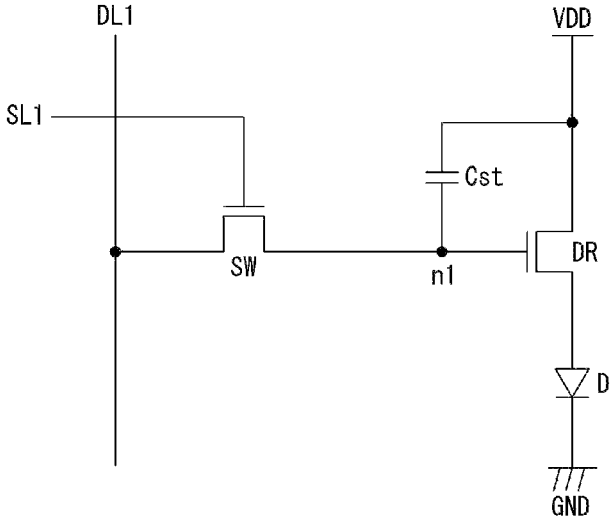
FIG. 2 is a circuit diagram showing a circuit configuration of a subpixel, according to an embodiment of the present invention.
Figure 3:
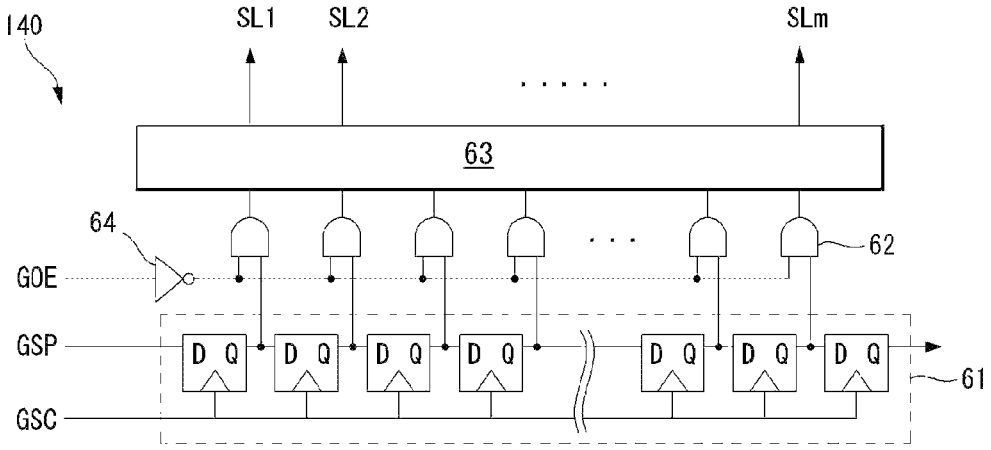
FIG. 3 is a block diagram of a scan driver, according to ane embodiment of the present invention.
Figure 4:
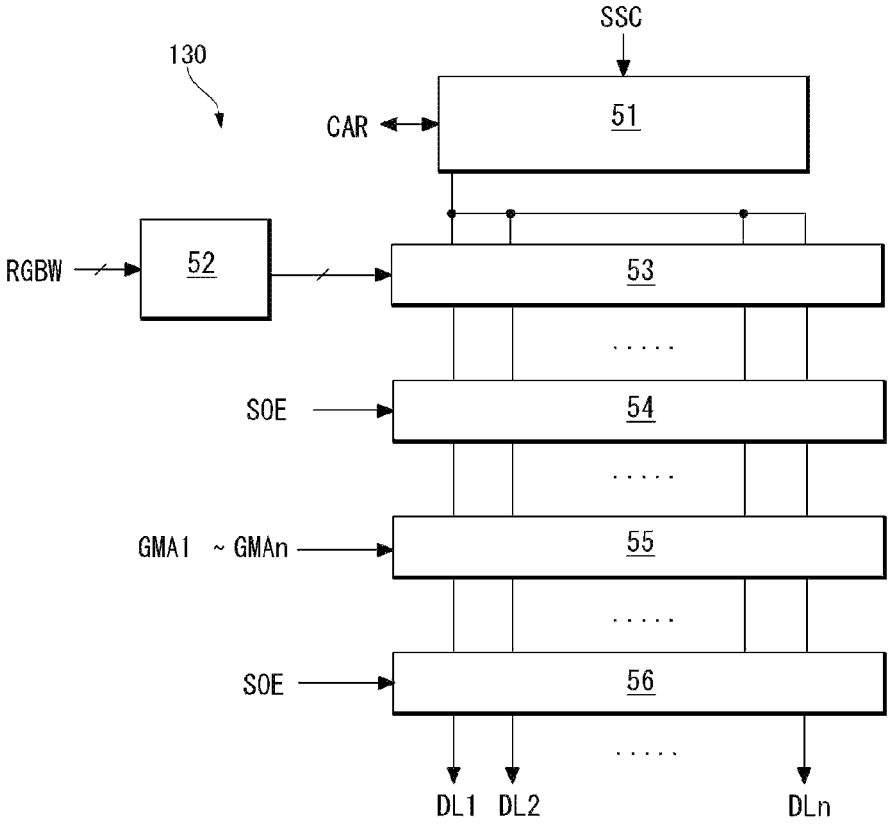
FIG. 4 is a block diagram of a data driver, according to an embodiment of the present invention.

Figure (FIG. 1 is a schematic block diagram of an organic light emitting display device according to an embodiment of the present invention. FIG. 2 is a view showing a circuit configuration of a subpixel, according to an embodiment of the present invention. FIG. 3 is a block diagram of a scan driver according to an embodiment of the present invention. FIG. 4 is a block diagram of a data driver according to an embodiment of the present invention.

The organic light emitting display device according to the embodiment of FIG. 1 includes an image processing unit 110, a timing controller 120, a data driver 130, a scan driver 140, and a display panel 150.

The display panel 150 is formed as an organic light emitting display panel including subpixels SPr, SPg, SPb, and SPw disposed in a matrix form. The subpixels SPr, SPg, SPb, SPw include a red subpixel SPr, a green subpixel SPg, a blue subpixel SPb, and a white subpixel SPw, that collectively constitute a single pixel P.

As shown in FIG. 2, each of the subpixels includes a switching transistor SW, a driving transistor DR, a capacitor Cst, and an organic light emitting diode (OLED) D. In response to a scan signal supplied through a first scan line SL1, the switching transistor SW performs a switching operation to allow a data signal supplied through a first data line DL1 to be supplied to a first node n1 so as to be stored as a data voltage in the capacitor Cst. The driving transistor DR operates to allow a driving current to flow between a first power source terminal VDD and a second power source terminal GND according to the data voltage stored in the capacitor Cst. The OLED D operates to emit light according to the driving current formed by the driving transistor DR.

As mentioned above, the subpixels SPr, SPg, SPb, and SPw may be configured to have a 2T (transistor) 1C (capacitor) structure including the switching transistor SW, the driving transistor DR, the capacitor Cst, and the OLED D, or may be configured to have a structure including additional transistors and capacitors, such as 3T1C, 4T2C, 5T2C, or the like.

The subpixels SPr, SPg, SPb, and SPw are formed according to a top emission scheme, a bottom emission scheme, or a dual-emission scheme according to a structure. Meanwhile, the red subpixel SPr, the green subpixel SPg, and the blue subpixel SPb are implemented according to a color filter usage scheme on the basis of the white subpixel SPw, or implemented according to a scheme in which an organic substance included in the OLED D of the subpixels is formed to have a corresponding color, or the like.

The image processing unit 110 receives a vertical synchronization signal, a horizontal synchronization signal, a data enable signal, a clock signal, and RGB data signals RGB. The image processing unit 110 converts the RGB data signals 'RGB' into RGBW data signals 'RGBW' and supplies the converted RGBW data signals to the timing controller 120. The image processing unit 110 sets a gamma voltage to implement peak luminance according to an average picture level (APL) by using the RGB data signals 'RGB.' The image processing unit 110 performs various types of image processing, details of which will be described hereafter.

The timing controller 120 receives the vertical synchronization signal, the horizontal synchronization signal, the data enable signal, the clock signal, and the RGBW data signals RGBW from the image processing unit 110. The timing controller 120 controls an operation timing of the data driver 130 and the scan driver 140 by using the timing signals such as the vertical synchronization signal, the horizontal synchronization signal, the data enable signal, the clock signal, and the like. The timing controller 120 may determine a frame period by counting the data enable signal of one horizontal period, so the vertical synchronization signal and the horizontal synchronization signal supplied from the outside may be omitted. Control signals generated by the timing controller include a gate timing control signal GDC for controlling an operation timing of the scan driver 140 and a data timing control signal DDC for controlling an operation timing of the data driver 130. The gate timing control signal GDC includes a gate start pulse, a gate shift clock, a gate output enable signal, and the like. The data timing control signal DDC includes a source start pulse, a source sampling clock, a source output enable signal, and the like.

In response to the gate timing control signal GDC supplied from the timing controller 120, the scan driver 140 sequentially generate scan signals while shifting signal levels with a swing width of a gate driving voltage at which transistors of the subpixels SPr, SPg, SPb, and SPw included in the display panel 150 are operable. The scan driver 140 supplies the generated scan signals to the subpixels SPr, SPg, SPb, and SPw included in the display panel 150 through scan lines SL1-SLm.

As shown in FIG. 3, the scan driver 140 includes a shift register 61, a level shifter 63, a plurality of logical product AND gates 62 connected between the shift register 61 and the level shifter 63, an inverter 64 for inverting a gate output enable signal GOE, and the like. The shift register 61 sequentially shifts a gate start pulse GSP by using a plurality of dependently connected D-flipflops according to a gate shift clock GSC. Each of the AND gates 62 ANDs an output signal from the shift register 61 and an inverted signal of the gate output enable signal GOE to generate an output. The inverter 64 inverts the gate output enable signal GOE and supplies the same to the AND gates 62. The level shifter 63 shifts an output voltage swing width of the AND gates 62 into a swing width of a scan voltage at which the transistors included in the display panel 150 is operable. Scan signals output from the level shifter 63 are sequentially supplied to the gate lines SL1-SLm.

In response to the data timing control signal DDC supplied from the timing controller 120, the data driver 130 samples the RGBW data signals RGBW supplied from the timing controller 120 and latches the sampled signals to convert them into data signals having a parallel data system. Here, when the data driver 130 converts the sampled signals into the data signals having a parallel data system, the data driver 130 converts the RGBW data signals RGBW from digital data signals into analog data signals according to a gamma voltage. Here, the digital data signals are converted into the analog data signals by a digital-to-analog converter (DAC) included in the data driver 130. The data driver 130 supplies the converted RGBW data signals RGBW to the subpixels SPr, SPg, SPb, and SPw included in the display panel 150 through the data lines DL1-DLn.

As shown in FIG. 4, the data driver 130 includes a shift register 51, a data register 52, a first latch 53, a second latch 54, a conversion unit 55, an output circuit 56, and the like. The shift register 51 shifts a source sampling clock SSC supplied from the timing controller 120. The shift register 51 delivers a carrier signal CAR to shift register of a source drive IC of a neighboring next stage. The data register 52 temporarily stores the data signals RGBW supplied from the timing controller 120 and supplies them to the first latch 53. The first latch 53 samples data signals RGBW input in series according to a clock sequentially supplied from the shift register 51, latches them, and then, simultaneously outputs the latched signals. The second latch 54 latches the data signals RGBW supplied from the first latch 53, and then, simultaneously outputs the latched signals in synchronization with the second latch 54 of different source drive ICs in response to a source output enable signal SOE. The conversion unit 55 converts the data signals RGBW input from the second latch 54 into gamma voltages GMA1~GMAn. The data signals RGBW output from the output circuit 56 are supplied to the data lines DL1~DLn in response to the source output enable signal SOE.

Figure 5:
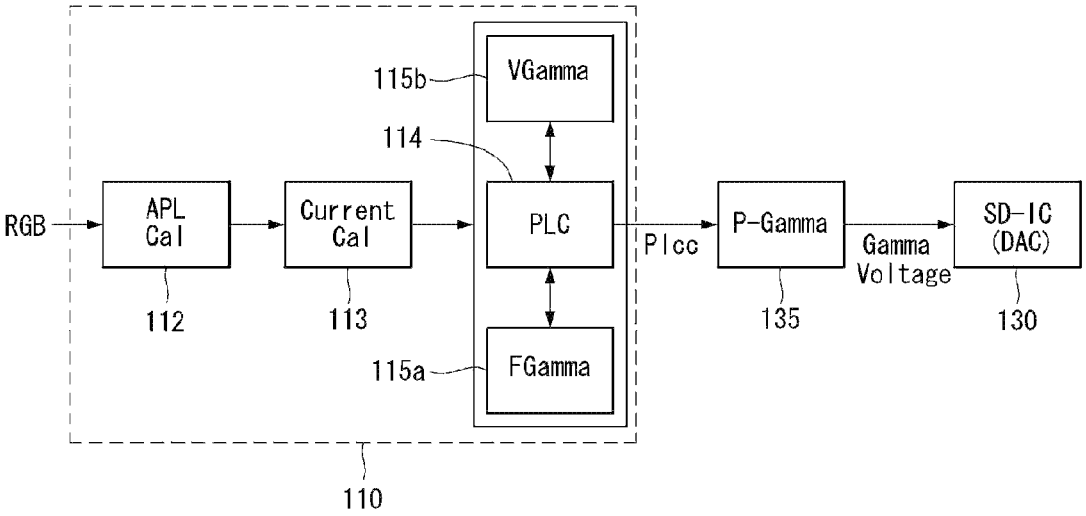
FIG. 5 is a schematic diagram illustrating an organic light emitting display device according to an embodiment of the present invention.
Figure 6:
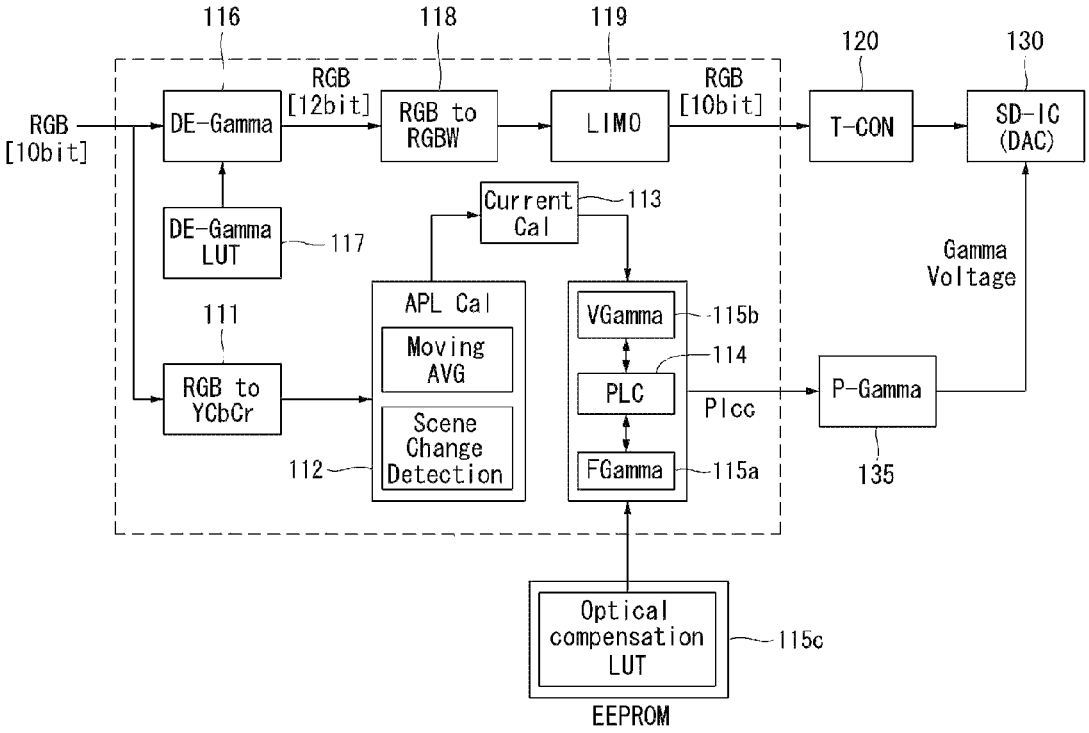
FIG. 6 is a detailed view illustrating an organic light emitting display device according to an embodiment of the present invention.
Figure 7:
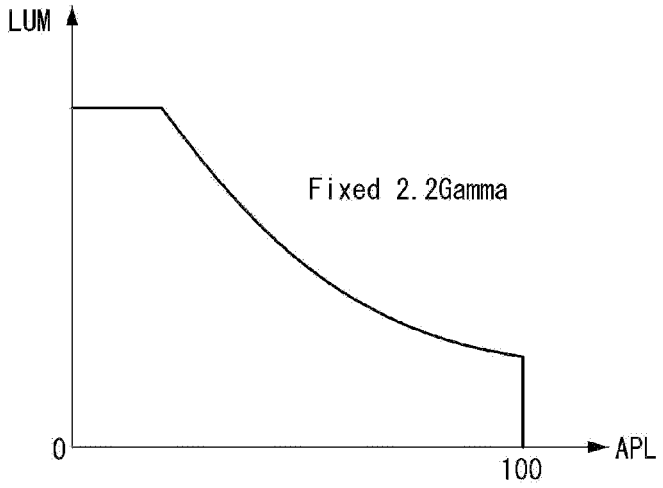
FIG. 7 is a graph of an average picture level over luminance according to a fixed gamma, according to an embodiment of the present invention.
Figure 8:
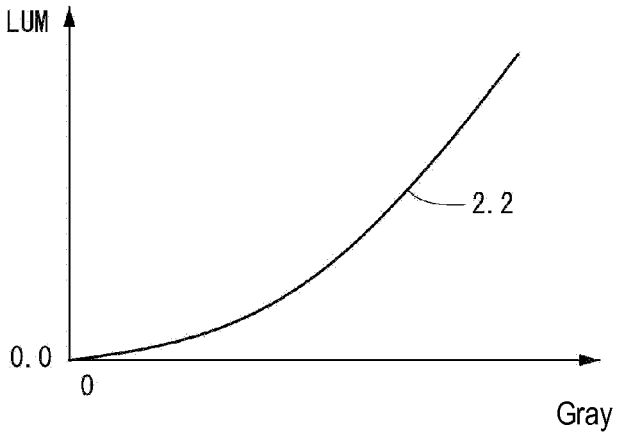
FIG. 8 is a graph of fixed gamma-based gray level over luminance, according to an embodiment of the present invention.

The organic light emitting display device according to an embodiment of the present invention will be described in more detail as follows. FIG. 5 is a view schematically illustrating an organic light emitting display device according to an embodiment of the present invention. FIG. 6 is a detailed view illustrating an organic light emitting display device according to an embodiment of the present invention. FIG. 7 is a graph of an average picture level over luminance according to a fixed gamma according to an embodiment of the present invention. FIG. 8 is a graph of fixed gamma-based gray level over luminance according to an embodiment of the present invention.

As shown in FIG. 5, the organic light emitting display device according to an embodiment of the present invention includes an average picture level calculation unit (APL Cal) 112, a current value calculation unit (Current Cal) 113, a peak luminance controller (PLC) 114, a programmable gamma unit (P-Gamma) 135, and a data driver (SD-IC) 130.

The average picture level calculation unit (Current Cal) 112 serves to calculate an average picture level (APL) with respect to an input image RGB. The current value calculation unit (Current Cal) 113 calculates a current value with respect to the APL, and when the calculated current value corresponds to a target current value, the current value calculation unit 113 outputs a first result value, and when the calculated current value does not correspond to the target current value, the current value calculation unit 113 outputs a second result value. When the first result value is supplied from the current value calculation unit 113, the peak luminance controller 114 output a first luminance control signal based on a first gamma conversion value, and when the second result value is supplied from the current value calculation unit 113, the peak luminance controller 114 output a second luminance control signal based on a second gamma conversion value. The programmable gamma unit 135 serves to output a gamma voltage corresponding to a luminance control signal Plcc supplied from the peak luminance controller 114. The data driver 130 generates a data signal based on the gamma voltage supplied from the programmable gamma unit 135 and supply the generated data signal to a display panel.

The image processing unit 110 may further include devices playing various roles, as well as the average picture level calculation unit 112, the current value calculation unit 113, and the peak luminance controller 114. An embodiment further including the devices within the image processing unit 110 will be described in more detail as follows.

As illustrated in FIG. 6, the image processing unit 110 includes a first data conversion unit (RGB to YCbCr) 111, the average picture level calculation unit 112, the current value calculation unit 113, the peak luminance controller 114, a de-gamma unit 116, a second data conversion unit (RGB to RGBW) 118, and a data compensation unit (LIMO) 119.

The DE-gamma unit 116 serves to de-gamma process the RGB data signals included in a single frame. In detail, in order to prevent a bit overflow, or the like, that occurs during an arithmetic operation of converting the RGB data signals input from the outside into the RGBW data signals, the DE-gamma unit 116 de-gamma processes a received inverse gamma to change it into a linear form, and then, performs bit stretching thereon. Here, through the bit stretching performed by the DE-gamma unit 116, the RGB data signals are changed from 10 bits to 12 bits. The DE-gamma unit 116 may perform bit stretching by using a DE-gamma look-up table (LUT).

The first data conversion unit (RGB to YCbCr) 111 serves to convert the RGB data signals supplied from the outside into YCbCr data signals. In this case, the first data conversion unit (RGB to YCbCr) 111 may convert the RGB data signals into the YCbCr data signals by using transformation formula such as Equation 1 shown below.

$$\begin{bmatrix} Y \\ Cb \\ Cr \end{bmatrix} = \begin{bmatrix} 0.299000 & 0.587000 & 0.114000 \\ -0.168736 & -0.331264 & 0.500000 \\ 0.500000 & -0.418688 & -0.081312 \end{bmatrix} \begin{bmatrix} R \\ G \\ B \end{bmatrix} \quad \text{[Equation 1]}$$

When the RGB data signals are converted into the YCbCr data signals, the APL calculation unit 112 may calculate an APL on the basis of the converted YCbCr data signals.

The second data conversion unit (RGB to RGBW) 118 serves to convert the RGB data signals output from the DE-gamma unit 116 into RGBW data signals. The reason for converting the RGB data signals into the RGBW data signals by using the second data conversion unit (RGB to RGBW) 118 is to drive the display panel including the RGBW subpixels.

When color coordinates of the W data signal among the RGBW data signals output from the second data conversion unit 118 are different from a target value, the data compensation unit (LIMO) 119 turns on the other remaining RGB data signals by a required amount together to thus perform compensation to express desired color coordinates. In case of using a display panel including RGBW subpixels, when a W image is expressed, only the W subpixel is used. In this case, when the color coordinates of the W subpixel are different from a target value, the data compensation unit 119 generates RGBW data signals (RGBW) such that a required amount of data signals selected from among RGB data signals are turned on in the display panel to express desired color coordinates. Here, the RGBW data signals RGBW are changed from 12 bits to 10 bits through a data conversion process by the data compensation unit 119. The RGBW data signals (RGBW) output through the data compensation unit 119 are output through the data driver 130 under the control of the timing controller 119.

The APL calculation unit 112 serves to arithmetically operate an averaged representative values through the YCbCr data signals supplied from the first data conversion unit 111 to calculate an APL. In case of the APL calculation unit 112, it can also calculate an APL through data signals of types other than the YCbCr data signals. In this case, rather than converting the RGB data signals into the YCbCr data signals, the first data conversion unit 111 may perform a different method, e.g., a method of extracting only a maximum value of the RGB data signals, or the like.

The APL calculation unit 112 may re-calculate the averaged representative values, i.e., may average again the averaged representative valued in units of Nth frames (e.g., 5 frames, 30 frames, or the like) so that the identical APL can be applied to a plurality of frames (certain amount of frames). This is to prevent a problem, such as flickering, or the like, that may arise when calculation is performed for every frame for expression. The APL calculation unit 112 may calculate the APL on the basis of a moving AVG of an image or on the basis of scene change detection.

The current value calculation unit 113 calculates a current value with respect to the APL supplied from the APL calculation unit 112. When the calculated current value corresponds to a target current value, the current value calculation unit 113 outputs a first result value, and when the calculated current value does not correspond to the target current value, the current value calculation unit 113 outputs a second result value. Here, the target current value is a value as a power consumption limit level of the display panel, which may be a measurement value, a calculation value, or the like, prepared based on a particular image having high power consumption.

As described above, the current value calculation unit 113 generates a result value based on a particular image having high power consumption. Thus, when the input image RGB is configured to have a single color (e.g., a single color full pattern image), the current value calculation unit 113 generates the first result value to allow the peak luminance controller 114 to stop gamma boosting. Meanwhile, when the input image RGB is configured to include multiple colors (e.g., a general image), the current value calculation unit 113 generates the second result value to allow the peak luminance controller 114 to perform gamma boosting. Namely, the first result value is a control signal for preventing the peak luminance controller 114 from performing gamma boosting, and the second result value is a control signal for allowing the peak luminance controller 114 to perform gamma boosting.

The peak luminance controller 114 serves to control maximum luminance for each frame by using an optical compensation LUT 115*c*. The peak luminance controller 114 may control maximum luminance by decreasing a current in a manner of using a fixed gamma or a variable gamma according to the result value supplied from the current value calculation unit 113. To this end, when the first result value is supplied from the current value calculation unit 113, the peak luminance controller 114 output a first luminance control signal based on a first gamma conversion value, and when the second result value is supplied from the current value calculation unit 113, the peak luminance controller 114 output a second luminance control signal based on a second gamma conversion value. In detail, when the first result value is supplied, the peak luminance controller 114 select a first gamma conversion value corresponding to a fixed gamma (FGamma) 115*a* and outputs a first luminance control signal. Meanwhile, when the second result value is supplied, the peak luminance controller 114 select a second gamma conversion value corresponding to a variable gamma (VGamma) 115*b* and outputs a second luminance control signal.

When the peak luminance controller 114 selects the first gamma conversion value corresponding to the fixed gamma 115*a*, it follows the APL/LUM graph as shown in FIG. 7. Thus, the programmable gamma unit 135, having received the first luminance control signal, follows the gray/LUM graph as shown in FIG. 8. In FIGS. 7 and 8, the fixed gamma 115*a* is defined to 2.2 gamma (Fixed 2.2 Gamma), but the present embodiment is not limited thereto.

Figure 9:
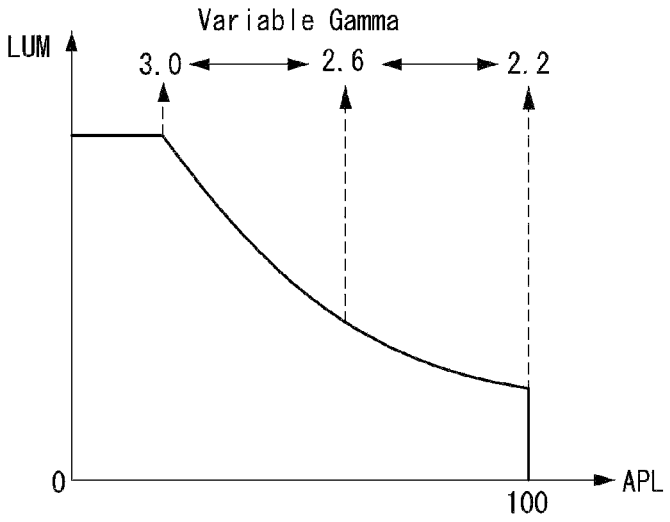
FIG. 9 is a graph of an average picture level over luminance according to a variable gamma, according to an embodiment of the present invention.
Figure 10:
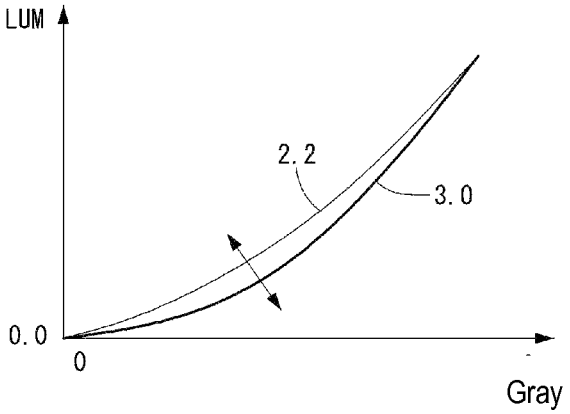
FIG. 10 is a graph of variable gamma-based gray level over luminance, according to an embodiment of the present invention.

When the peak luminance controller 114 select the second gamma conversion value corresponding to the variable gamma 115*b*, it follows the APL/LUM graph as shown in FIG. 9. Thus, the programmable gamma unit 135, which has received the second luminance control signal, follows the gray/LUM graph as shown in FIG. 10. In detail, when the second result value is supplied, the peak luminance controller 114 select the second gamma conversion value corresponding to the variable gamma 115*b* to generate a second luminance control signal for controlling luminance of one or two selected from among a high gray level, a middle gray level, and a low gray level. For example, the peak luminance controller 114 may control the programmable gamma unit 135 to follow 2.2 gamma in a high gray level, 2.6 gamma in a middle gray level, and 3.0 gamma in a low gray level. Namely, the variable gamma 115*b* includes a gamma band from 2.2 to 3.0, and the gamma band may be shifted from the 2.2 gamma to 3.0 gamma according to an input image RGB.

The peak luminance controller 114 generates the second luminance control signal for increasing luminance of a high gray level and decreasing luminance of a low gray level, applies the variable gamma 115*b*, and decreases a current value to a target current value. Here, the peak luminance controller 114 performs overall adjustment to increase luminance of a high gray level and decrease luminance of a low gray level, as well as simply reducing luminance by the applied gamma value. As a result, the programmable gamma unit 135 may output a gamma-boosted gamma voltage in order to secure a high contrast ratio (CR) for the same current based on the variable gamma. Therefore, the display panel can obtain a high contrast ratio (CR) and achieve perceptual picture quality enhancement.

Figure 11:
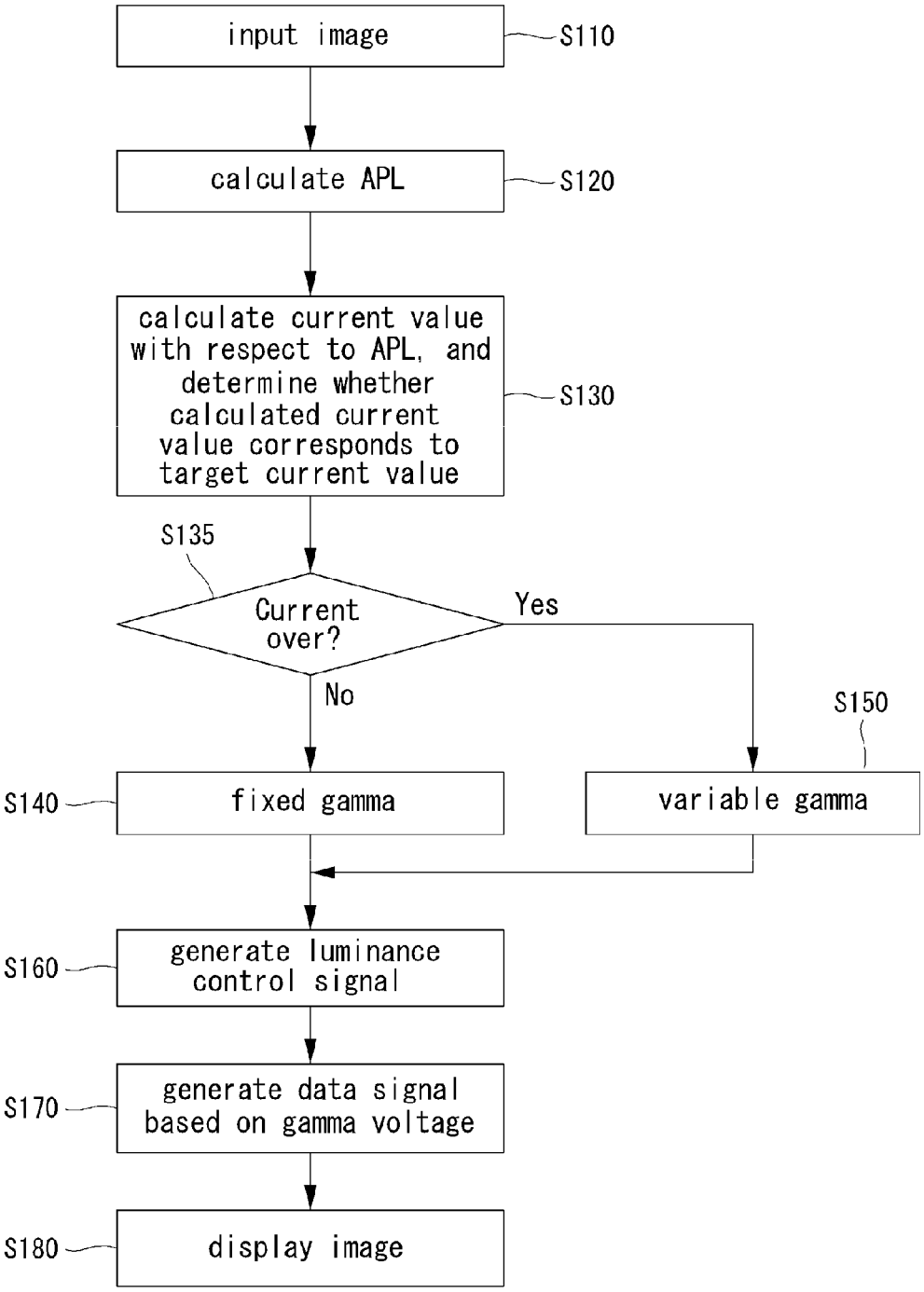
FIG. 11 is a flow chart illustrating a method for driving an organic light emitting display device, according to an embodiment of the present invention.

A method for driving an organic light emitting display device according to an embodiment of the present invention will be described. FIG. 11 is a flow chart illustrating a method for driving an organic light emitting display device according to an embodiment of the present invention. A driving method described hereinafter may use the devices described above with reference to FIGS. 1 through 10, but the present invention is not limited thereto.

First, when an image is input (S110), an average picture level (APL) of the input image is calculated (S120).

Next, a current value of the APL is calculated, and it is determined whether or not the calculated current value corresponds to a target current value (S130).

When the calculated current value corresponds to the target current value (S135, No), the first gamma conversion value corresponding to a variable gamma is selected (S140), generate a first luminance control signal and output the same (S160). Meanwhile, when the calculated current value differs from the target current value (S135, Yes), a second gamma conversion value corresponding to the variable gamma is selected (S150), generate a second luminance control signal and output the same (S160).

Thereafter, in the step (S160) of generating and outputting the luminance control signal, when the calculated current value differs from the target current value (S135, Yes), a variable gamma is selected and decrease a current so that the input image corresponds to the target current value.

In the step (S160) of generating and outputting the luminance control signal, when the calculated current value differs from the target current value (S135, Yes), the second gamma conversion value is selected and generate a second luminance control signal to allow luminance of one or two selected from among a high gray level, a middle gray level, and a low gray level to be controlled. Here, the second luminance control signal increases luminescence of a high gray level and decreases luminance of a low gray level.

In the step (S160) of generating and outputting the luminance control signal, when the input image is configured to have a single color, the first luminance control signal is generated to stop gamma boosting. Meanwhile, when the input image includes multiple colors, the second luminance control signal is generated to perform gamma boosting according to peak luminance control.

Meanwhile, the variable gamma as described above includes a gamma band from 2.2 to 3.0, and the gamma band of the variable gamma may be shifted from 2.2 gamma to 3.0 gamma according to an input image RGB, but the present invention is not limited thereto.

Thereafter, a data signal is generated based on a gamma voltage corresponding to one of the first luminance control signal and the second luminance control signal (S170).

And then, an image is displayed with the data signal generated based on the gamma voltage (S180).

In order to help understand the foregoing driving method, an embodiment will be described as follows by comparing a multi-color image and a single color image.

Figure 12:
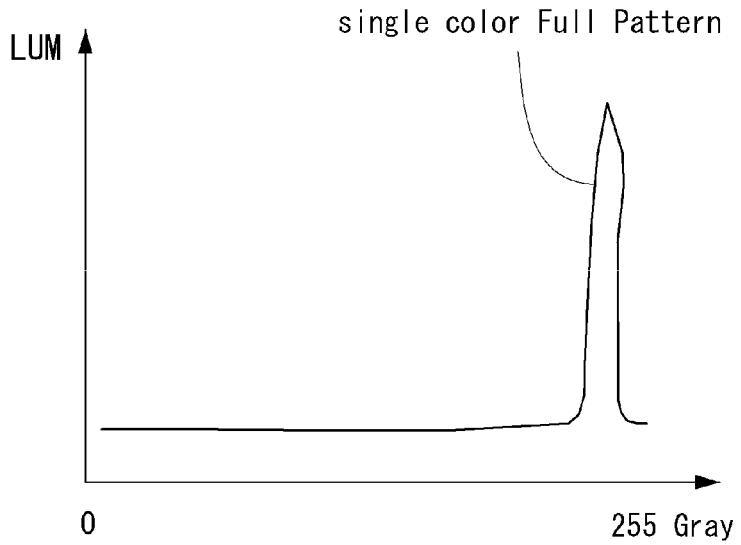
FIG. 12 is a graph of a gray level over luminance with respect to monochrome image, according to an embodiment of the present invention.
Figure 13:
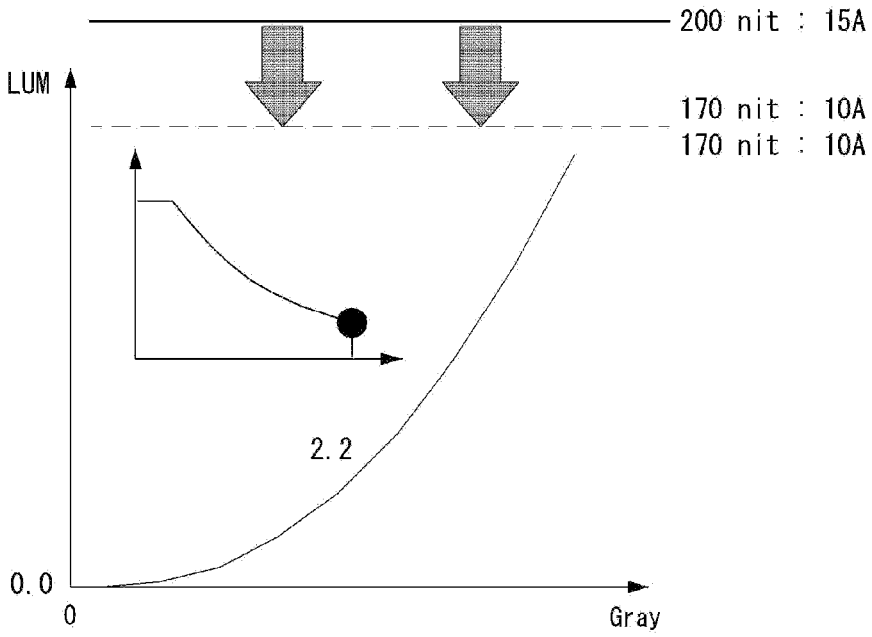
FIG. 13 is a graph of gray level over luminance when a fixed gamma is applied to a monochrome image, according to an embodiment of the present invention.
Figure 14:
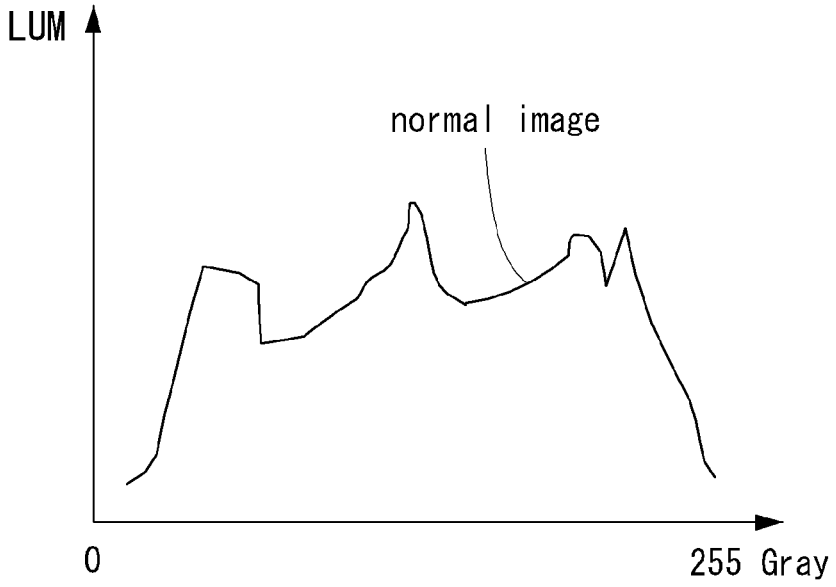
FIG. 14 is a graph of a gray level over luminance with respect to multi-color image, according to an embodiment of the present invention.
Figure 15:
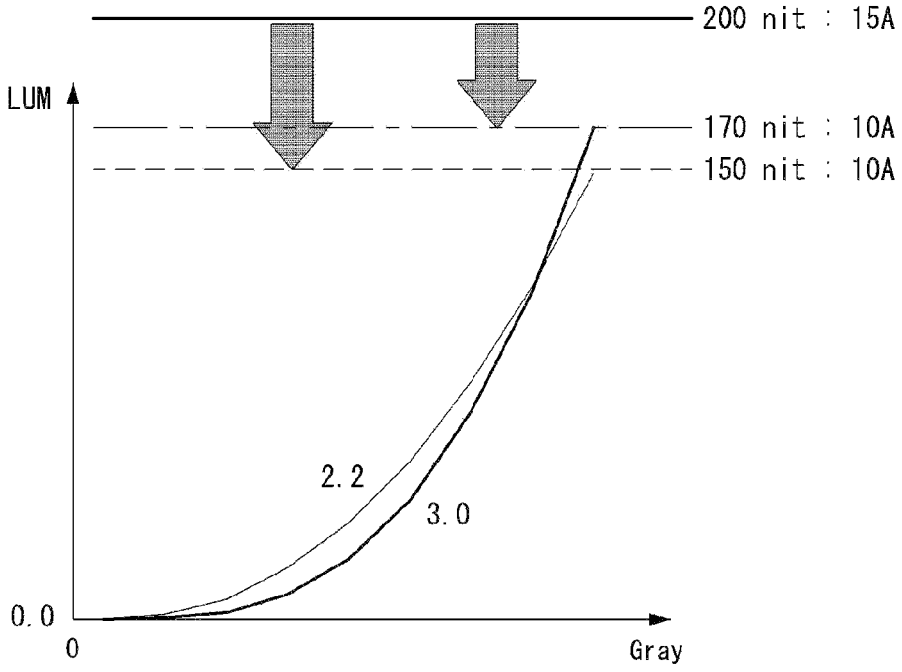
FIG. 15 is a graph of gray level over luminance when a variable gamma is applied to a multi-color image, according to an embodiment of the present invention.

FIG. 12 is a graph of a gray level over luminance with respect to monochrome image, according to an embodiment of the present invention. FIG. 13 is a graph of gray level over luminance when a fixed gamma is applied to a monochrome image, according to an embodiment of the present invention. FIG. 14 is a graph of a gray level over luminance with respect to multi-color image, according to an embodiment of the present invention. FIG. 15 is a graph of gray level over luminance when a variable gamma is applied to a multi-color image, according to an embodiment of the present invention.

As illustrated in FIG. 12, when an input image is a monochrome image (single color full pattern), the peak luminance controller 114 controls the programmable gamma unit 135 to follow the gray/LUM as shown in FIG. 13 by applying a fixed gamma. Here, the input monochrome image satisfies a target current value, so an image displayed on the display panel has luminance reduced from 200 nits to 170 nits according to the peak luminance control method. Here, the monochrome image follows the fixed gamma, and hence, the image has the same luminance for each gray level, while consuming a current value 10 ampere (A).

As illustrated in FIG. 14, when an input image is a multi-color image (a normal image), the peak luminance controller 114 controls the programmable gamma unit 135 to follow the gray/LUM as shown in FIG. 15 by applying a variable gamma. Here, the input multi-color image does not satisfy the target current value, an image displayed on the display panel has luminance reduced from 200 nits to 150 nits and 170 nits according to the peak luminance control method. Here, since the multi-color image follows the variable gamma, it has low luminance (150 nits) in a low gray level and high luminance (170 nits) in a high gray level, while consuming a current value 10 ampere (A). When driving is performed in this manner, a contrast ratio of an image degraded when power consumption is lowered can be enhanced, and thus, perceptual picture quality enhancement can be obtained.

As described above, the embodiments of the present invention provides an organic light emitting display device in which, in performing peak luminance control on a display panel including RGBW subpixels, a variable gamma is set for each PLC, and when a target current value is exceeded, a corresponding variable gamma is applied to lower a current value, and a driving method thereof can be provided. Also, the embodiments of the present invention provides an organic light emitting display device in which, in performing peak luminance control on a display panel including RGBW subpixels, a power consumption limit level is not exceeded, and a constant ratio of an image degraded when power consumption is lowered is enhanced, thus obtaining perceptual picture quality enhancement, and a driving method thereof can be provided.

What is claimed is:

1. An organic light emitting display device comprising:

an average picture level (APL) calculation unit configured to calculate an APL of an input image;

a current value calculation unit configured to calculate an electric current value with respect to the APL, output a first result value when a calculated electric current value corresponds to a target electric current value, and output a second result value when the calculated electric current value differs from the target electric current value;

a peak luminance controller configured to output a first luminance control signal based on a first gamma conversion value when the first result value from the current value calculation unit is received and output a second luminance control signal based on a second gamma conversion value when the second result value from the current value calculation unit is received;

a programmable gamma unit configured to output a gamma voltage corresponding to a luminance control signal supplied from the peak luminance controller; and a data driver configured to generate a data signal based on the gamma voltage supplied from the programmable gamma unit and supply the generated data signal to a display panel, wherein when the first result value is received, the peak luminance controller applies the first gamma conversion value corresponding to a fixed gamma value to output the first luminance control signal, and when the second result value is supplied, the peak luminance controller applies the second gamma conversion value corresponding to a first gamma value in a first range of gray level, a second gamma value higher than the first gamma value in a second range of gray level lower than the first range, and a third gamma value higher than the second gamma value in a third range of gray level lower than the second range.

2. The organic light emitting display device of claim 1, wherein when the second result value is received, the peak luminance controller decreases electric current such that the input image corresponds to the target electric current value.

3. The organic light emitting display device of claim 1, wherein when the input image includes only a single color, the current value calculation unit is configured to generate the first result value to allow the peak luminance controller to stop gamma boosting, and when the input image includes multiple colors, the current value calculation unit is configured to generate the second result value to allow the peak luminance controller to perform gamma boosting.

4. The organic light emitting display device of claim 1, wherein the display panel includes RGBW subpixels.

5. The organic light emitting display device of claim 1, wherein the fixed gamma value corresponds to the first gamma value.

6. The organic light emitting display device of claim 5, wherein the first gamma value is 2.2, the second gamma value is 2.6 and the third gamma value is 3.0.

7. A method for driving an organic light emitting display device, the method comprising:

calculating an average picture level (APL) of an input image;

calculating an electric current value with respect to the APL, and determining whether the calculated electric current value corresponds to a target electric current value;

outputting a first luminance control signal based on a first gamma conversion value corresponding to a fixed gamma value when the calculated electric current value corresponds to the target electric current value;

outputting a second luminance control signal based on a second gamma conversion value corresponding to a first gamma value in a first range of gray level, a second gamma value higher than the first gamma value in a second range of gray level lower than the first range, and a third gamma value higher than the second gamma value in a third range of gray level lower than the second range when the calculated electric current value differs from the target electric current value; and generating a data signal based on a gamma voltage corresponding to one of the first luminance control signal and the second luminance control signal to display the input image.

8. The method of claim 7, wherein, in the outputting of the luminance control signal, electric current is decreased such that the input image corresponds to the target current value.

9. The method of claim 7, wherein, in the outputting of the luminance control signal, when the input image includes only a single color, the first luminance control signal is generated to stop gamma boosting according to peak luminance control, and when the input image includes multiple colors, the second luminance control signal is generated to perform gamma boosting according to peak luminance control.

10. The method of claim 7, wherein the fixed gamma value corresponds to the first gamma value.

11. The method of claim 10, wherein the first gamma value is 2.2, the second gamma value is 2.6 and the third gamma value is 3.0.

* * * * *